US006416876B1

(12) United States Patent
Deve et al.

(10) Patent No.: US 6,416,876 B1
(45) Date of Patent: Jul. 9, 2002

(54) COPPER MATRIX COMPOSITES

(75) Inventors: Herve E. Deve, Minneapolis; John D. Skildum, North Oaks, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 88 days.

(21) Appl. No.: 09/663,084

(22) Filed: Sep. 15, 2000

Related U.S. Application Data

(60) Provisional application No. 60/156,136, filed on Sep. 27, 1999, and provisional application No. 60/179,971, filed on Feb. 3, 2000.

(51) Int. Cl.[7] ..... B32B 15/14; B32B 15/20; B21D 39/03; H01F 16/00

(52) U.S. Cl. ..... 428/539.5; 428/611; 428/621; 428/674; 174/128.1; 164/289

(58) Field of Search ..... 428/539.5, 611, 428/621, 674; 174/128.1; 164/289

(56) References Cited

U.S. PATENT DOCUMENTS 6,329,056 B1 * 12/2001 Deve et al.

FOREIGN PATENT DOCUMENTS

WO WO 98/11265 3/1998

OTHER PUBLICATIONS

Y. Sakaki et al., "Strength and Conductivity of Cu–Ag Microcomposites", Materials for Magnets: High Strength Conductors, vol. IV, 1997, pp. 477–488, No Month.

P. Pernambuco–Wise, "Pulse Magnets at the National High Magnetic Field Laboratory: Present and Future", Generation of High Magnetic Fields: Laboratory Magnets, vol. III, 1997, pp. 371–380, No Month.

Derwent Abstract for JP 1232613 A, Mar. 12, 1988.

Derwent Abstract for JP 6108182 A, Sep. 29, 1992.

Derwent Abstract for RU 2074424 C, Dec. 14, 1994.

Sep. 11, 1998 e–mail from John Skildum (3M#) to Ke Han (LANL##).

Sep. 14, 1998 e–mail from Ke Han (LANL##) to John Skildum (3M#).

Sep. 15, 1998 e–mail from Ke Han (LANL##) to John Skildum (3M#).

Sep. 17, 1998 e–mail from John Skildum (3M#) to Ke Han (LANL##).

Sep. 24, 1998 e–mail from Ke Han (LANL##) to John Skildum (3M#).

Sep. 24, 1998 e–mail from John Skildum (3M#) to Ke Han (LANL##).

Sep. 25, 1998 e–mail from John Skildum (3M#) to Ke Han (LANL##).

Sep. 30, 1998 e–mail from Ke Han (LANL##) to John Skildum (3M#).

Oct. 1, 1998 e–mail from Ke Han (LANL##) to John Skildum (3M#).

* cited by examiner

*Primary Examiner*—Deborah Jones
*Assistant Examiner*—Jason Savage
(74) *Attorney, Agent, or Firm*—Gregory D. Allen

(57) ABSTRACT

Copper matrix composites reinforced with continuous SiC and/or boron fibers.

46 Claims, 2 Drawing Sheets

COPPER MATRIX COMPOSITES

This application claims priority to U.S. application Ser. No. 60/156,136, filed Sep. 27, 1999, now pending; and U.S. application Ser. No. 60/179,971, filed Feb. 3, 2000, now pending.

FIELD OF THE INVENTION

The present invention relates to copper matrix composites reinforced with at least one of continuous, monofilament SiC or boron fibers.

DESCRIPTION OF RELATED ART

A variety of relatively high strength materials (e.g., microcomposites such as Cu—Nb and Cu—Ag alloys) having relatively high electrical conductivity are known (see, e.g., "Strength And Conductivity of Cu—Ag Microcomposites", Sakai, T. Asano, K. Inoue, and H. Maeda, pp. 477–488, Chapter IV, in Proceedings of "High Magnetic Fields, Applications, Generation and Material", Edited by H. J. Schneider-Muntau, Singapore, *World Scientific*, 1997. Typically, as the strength of such materials increases, their electrical conductivity decreases, and vice versa.

Uses of high strength materials having relatively high electrical conductivity include electromagnetic applications, such as pulse magnets, which are used in high field strength magnets. The conductors used in these magnets need to be capable of withstanding high stresses created by strong magnetic fields, as well as be capable of maintaining their strength at the elevated temperatures associated with the use of these magnets. Further, the conductor materials should have sufficiently flexible to be bent over a small radius of curvature (e.g., a radius of 10 mm or less. Typically, the conductors used in high field strength magnet applications need to have an average tensile strength, at about 25° C., of at least 0.7–1.5 GPa.

There is a continuing need for materials that have both high strength and high electrical conductivity.

SUMMARY OF THE INVENTION

The present invention provides a copper matrix composite (CMC) article (comprising at least one layer of a plurality of at least one of continuous, longitudinally aligned (i.e., parallel alignment of the fibers along the length of the article), non-touching (i.e., individual longitudinally aligned reinforcing fibers do not touch due to the copper metal matrix between each of the reinforcing fibers), monofilament SiC or boron reinforcing fibers. Preferably, the CMC article has, at 25° C., an average tensile strength of at least 0.7 GPa (more preferably, at least 0.8 GPa; even more preferably, at least at least 0.9 GPa, and most preferably, at least 1 GPa, 1.25 GPa, 1.5 GPa, 1.6 GPa, or even 1.65 GPa). The average electrical conductivity of the CMC article preferably is at least 50% IACS (more preferably, at least 55% IACS; even more preferably, at least 60% IACS, or even at least 70% IACS; and most preferably, at least 75% IACS). Preferably, CMC articles according to the present invention are at least about 20 meters, and more preferably at least about 30 meters in length, although longer lengths may be desirable for certain applications.

Typically the CMC according to the present invention is elongated (typically having a length of at least 100 (preferably, at least 1,000, or even 10,000) times its thickness; wherein the length is at least 3 meters) and is continuous in length (i.e., having a length of at least 1 meter, preferably, at least 3 meters, more preferably, at least 10 meters).

In one aspect, the present invention provides a copper matrix composite article (typically, an elongated, continuous copper matrix composite article) comprising at least one layer of a plurality of at least one of continuous, longitudinally aligned, non-touching, monofilament SiC or boron reinforcing fibers, wherein the elongated article has, at 25° C., an average tensile strength of at least 0.7 GPa (preferably, at least 0.8 GPa; more preferably, at least 0.9 GPa, and most preferably, at least 1 GPa, 1.25 GPa, 1.5 GPa, 1.6 GPa, or even 1.65 GPa) and an electrical conductivity of is at least 50% IACS (preferably, at least 55% IACS; more preferably, at least 60% IACS, or even at least 70% IACS; and most preferably, at least 75% IACS), and wherein the copper of the copper matrix has an average grain size of greater than 10 micrometers (in some case greater than 15 micrometers, greater than 20 micrometers, greater than 25 micrometers, greater than 30 micrometers, greater than 40 micrometers, even greater than 50 micrometers; typically in the range from greater than 10 micrometers up to 150 micrometers; more typically in the range from greater than 10 micrometers up to 55 micrometers).

In another aspect, the present invention provides, copper matrix composite article (typically, an elongated, continuous copper matrix composite article) comprising at least one layer of a plurality of at least one of continuous, longitudinally aligned, non-touching, monofilament SiC or boron reinforcing fibers, wherein the elongated article has, at 25° C., an average tensile strength at least 0.7 GPa (preferably, at least 0.8 GPa; more preferably, at least at least 0.9 GPa, and most preferably, at least 1 GPa, 1.25 GPa, 1.5 GPa, 1.6 GPa, or even 1.65 GPa) and an electrical conductivity of at least 50% IACS (preferably, at least 55% IACS; more preferably, at least 60% IACS, or even at least 70% IACS; and most preferably, at least 75% IACS), and wherein the elongated article is capable of retaining at least 90 percent (preferably at least 95 percent; more preferably, 100 percent of its average tensile strength (measured at 25° C.) and/or increasing its electrical conductivity, after being annealed for 3 minutes at 850° C. in an argon environment with less than 5 ppm oxygen and less than 10 ppm water. Preferably, the increase in electrical conductivity after annealing is at least 1% IACS, more preferably 2% IACS, and even more preferably 4% IACS.

Copper matrix composite articles according to the present invention are useful, for example, in high field pulsed magnet applications.

DETAILED DESCRIPTION

Figure 1:
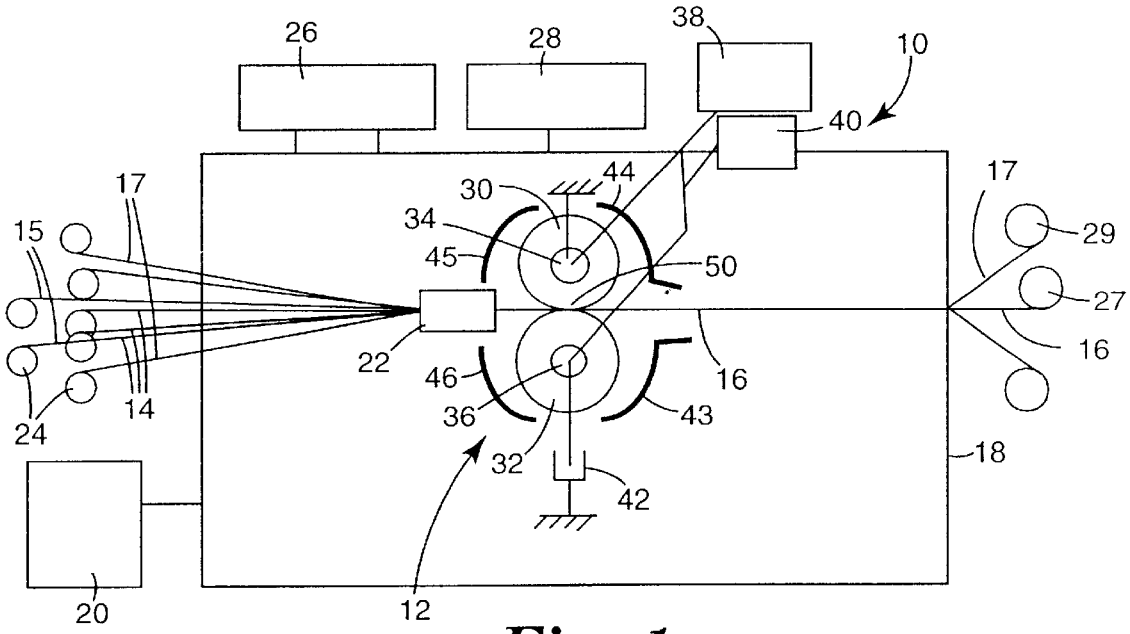
FIG. 1 is a schematic of a consolidating apparatus for use in a process according to the present invention to prepare a copper matrix composite tape according to the present invention.

Copper matrix composite articles according to the present invention have a desirable combination of high tensile strength and high electrical conductivity.

Preferably the purity of the copper used to make the articles according to the present invention, as well as the copper matrix of the composite articles according to the present invention is at least 99.5% (preferably, at least 99.9% (i.e., contains no more than 0.1% by weight impurities (i.e., elements other than copper), wherein it is understood that the outer surface of the CMC article may include impurities such as oxygen in the form of copper oxide); more preferably, at least 99.95%) pure copper by weight (based on the total weight of the copper matrix). Particularly undesirable impurities are oxygen and metallic elements (e.g., oxygen is typically lower than 0.04%, more preferably less than 10 ppm, and residual metallic impurities including sulfur are typically less than 50 ppm) include those that decrease the electrical conductivity of the copper. It is also understood that porosity is not considered to be an impurity.

Suitably pure copper materials for making CMC composite articles according to the present invention are commercially available, and typically are electrical grade copper materials. For example, suitable 99.5%, 99.9%, and 99.95% pure copper include UNS (Unified Numbering System) (see ASTM B 170-93, volume 02–03 on "Electrical Conductors" (1993), the disclosure of which is incorporated herein by reference) "C11000" (electrolytic tough pitch) copper, "C10100" (oxygen free-electronic) copper, and "C10200" (oxygen-free) copper, respectively, all of which are available, for example, from US Brass and Copper, Dawner Groove, Ill.

Suitable forms of the copper for forming the copper matrix may include foils, and ribbons. The form of the copper selected to make CMC articles according to the present invention may depend, for example, on the process used to make the CMC, the desired properties of the resulting CMC, and/or the intended use of the resulting CMC. Typically, the thickness of the copper foil or ribbon is about 0.1 mm to about 0.2 mm. The length of the copper foil or ribbon, as well as the length of the SiC fiber, are selected to be at least as long as the length of the desired CMC article.

The continuous SiC fibers are polycrystalline fibers that are substantially silicon carbide, although such fibers typically inherently have a thin carbon coating on their outer surfaces. Suitable monofilament SiC (reinforcing) fibers are preferably relatively high in strength and generally have limited or low ductility as compared to the copper matrix. Preferably, the average tensile strength of the SiC fibers is at least 2.7 GPa; more preferably, at least 3.45 GPa; and even more preferably, at least 6 GPa.

The diameter of the SiC fibers are typically in the range from about 0.08 millimeter to about 0.2 millimeter. Suitable SiC fibers are commercially available, for example, in lengths of at least 100 meters, and up to at least 1000 meters.

The SiC fibers may include a coating or layer of material to protect the fiber during handling and/or to improve the bonding between the fiber and the copper matrix. The coating can be made of multiple layers of the same and/or different materials. Examples of coating materials include titanium and carbon. For example, to promote bonding between the fiber and the matrix a SiC fiber could have a thin (i.e., 1–3 micrometers) protective carbon coating and another coating (e.g., titanium or silicon carbide) over the carbon coating. Suitable titanium coatings can be provided, for example, by electron beam evaporation, such as described in PCT application having International Publication No. WO 92/14860, published Sep. 3 1992, the disclosure of which is incorporated herein by reference.

Examples of suitable commercially available continuous, monofilaments SiC reinforcing fibers include those marketed by Textron Specialty Materials, Lynn, Mass. under the trade designations "SCS-6", "SCS-ULTRA", and "SCS-8." These Textron Specialty Materials fibers have a double layer of carbon rich coating. The coating on the "SCS-6" silicon carbide fibers have been examined in details by other investigators (see, e.g., E. Hall and A. M. Ritter, J. Mater. Res., 8, 1158, 1993, the disclosure of which is incorporated herein by reference) and is reported to comprised of two carbon-rich layers which contain very fine SiC crystallites. Alternatively, Textron Specialty Materials is known to have a process for modify the second coating layer to produce a silicon-rich coating. The SiC fibers coated with the silicon-rich coating has been commercialized in the past under the trade designation "SCS-8".

The continuous boron fibers are polycrystalline fibers that are substantially boron. Suitable fibers can be made, for example, by depositing boron on a small diameter substrate wire such as tungsten. The boron monofilaments are preferably relatively high in strength and generally have limited or low ductility as compared to the copper matrix. Preferably, the average tensile strength of the boron fiber is at least 2.7 GPa; more preferably, at least 3.45 GPa; and more preferably at least 3.6 GPa.

The diameter of the boron monofilaments are preferably in the range from 0.06 millimeter to about 0.2 millimeter, more typically available in the range from 0.1 millimeter to about 0.14 millimeter. Suitable boron fibers are commercially available, for example, in lengths of at least 100 meters, and up to at least 1000 meters.

The boron fibers are typically uncoated and have a rough surface texture. Although not wanting to be bound by theory, it is believed that the rough surface texture promotes mechanical interlocking between the fiber and the copper matrix.

Example of suitable commercially available continuous boron fibers include those marketed by Textron Specialty Materials. Such fibers, which are uncoated, are available from Textron Specialty Materials in both 0.1 millimeter and 0.14 millimeter diameters.

A continuous CMC tape according to the present invention can be made, for example, by consolidating copper metal foils and at least one of continuous, monofilament SiC or boron fibers. The thickness of the foil is selected to yield a CMC article with a fiber volume fraction ranging from 10 to 40 volume percent; preferably, from 20 to 30 volume percent, based on the total volume of the article.

A plurality of copper foils and aligned SiC and/or boron fibers can be consolidated into a CMC tape according to the present invention by the application of heat and pressure to effect the plastic flow of the copper foils such that interstitial spaces are filled with the copper matrix and adjacent SiC and/or boron fibers are bonded together.

In one aspect, the present invention provides a continuous process of consolidating the SiC and/or boron fibers into a continuous CMC tape, preferably a continuous CMC monotape. The continuous tape can then be used to make a variety of articles by consolidating multiple layers (e.g., multiple winds or plies) of the tape. These processes take advantage of the plastic flow of the copper matrix material under the application of heat and pressure.

One preferred process for preparing a continuous CMC tape according to the present invention involves longitudinally aligning and consolidating a plurality of continuous SiC and/or boron fibers between copper foils. The consolidation occurs in a nonreactive environment (i.e., an environment that is not reactive with either the copper (metal)

matrix material or the reinforcing SiC and/or boron (or coatings thereon) fibers), under the application of heat and pressure.

Referring to FIG. 1, a consolidation process can be carried out using consolidating apparatus 10, which includes: consolidating means 12 for consolidating continuous copper foils 15 and SiC (and/or boron) fibers 14 into elongated, continuous copper matrix composite tape 16 under the application of heat and pressure; means for providing a nonreactive environment around the consolidating means, which can include, for example, enclosure 18 that can be evacuated and/or a source of nonreactive gas 20; and alignment means 22 to effect longitudinal alignment of continuous SiC (and/or boron) fibers 14 and copper foils 15. Preferably, consolidating means 12 is contained within enclosure 18. Consolidating apparatus 10 typically further includes supply means 24, such as supply spools, to provide a plurality of continuous SiC (and/or boron) fibers 14 and copper foils 15, and collecting means 27, such as a collecting spool, to collect the continuous copper matrix composite tape. Supply means 24 and collecting means 27 may or may not be positioned within enclosure 18. Preferably they are outside enclosure 18.

Consolidation (i.e., bonding) of the SiC (and/or boron) fibers is carried out in a nonreactive environment to avoid contamination of the copper matrix material, particularly at high temperatures. A nonreactive environment can include an atmosphere of a nonreactive gas (often referred to as an inert gas) such as argon. Alternatively, the foils and fibers can be consolidated under reduced pressure (e.g., as in an evacuated enclosure such as a vacuum-box). Preferably, the nonreactive environment includes less than about 100 ppm oxygen, and less than about 1000 ppm water vapor. More preferably, the nonreactive environment includes less than about 10 ppm oxygen, and less than about 10 ppm water vapor. Most preferably, the nonreactive environment includes less than about 1 ppm oxygen, and less than about 10 ppm water vapor.

Referring again to FIG. 1, enclosure 18 is preferably made of materials with low permeability to oxygen and water vapor. A suitable enclosure 18 at least for'small scale production of continuous CMC tape according to the present invention, is, for example, a glove-box such as that commercially available from T-M Vacuum Products Inc., Cinnamison, N.J. Additionally, oxygen and moisture gettering unit 26, can be used to purify a nonreactive gas such as argon. Suitable oxygen and moisture getters and systems are commercially available, and include those available from VAC of Hawthorne, Calif. Further, enclosure 18 may include a sensor(s) 28 to monitor the oxygen and water vapor content therein. Suitable oxygen and water vapor sensors are commercially available, and include those available from Panametrics of Waltham, Mass.

To consolidate the copper foils and the SiC (and/or boron) fibers to form a CMC tape, heat and pressure are applied for a time sufficient to effect the plastic flow of the copper matrix material such that interstitial spaces between adjacent fibers are filled with copper matrix. This is accomplished through the use of consolidating means, which includes means for applying heat and pressure. This can be accomplished through the use of platens or rolls, preferably rolls, which can be made of ceramic (including crystalline ceramics), graphite, metal, or combinations thereof. Preferably, at least two rolls are used and positioned such that the continuous copper (metal) foils and parallel SiC (and/or boron) fibers are advanced between the nip 50 of the rolls under the application of heat and pressure.

Referring to FIG. 1, which displays a preferred consolidating means 12, there is shown two parallel consolidating rolls (upper roll 30 and lower roll 32), each of which are mounted on water-cooled shaft 34 and 36. Consolidating rolls 30 and 32 can be of a variety of sizes and made of a variety of materials. The main requirements for roll selection are good strength, high modulus, and slow kinetics of reaction with the metal matrix material. Consolidating rolls 30 and 32 should have sufficient strength to resist large indentation stresses during operation, such as that resulting from the SiC (and/or boron) fibers, which can be about 10–275 MPa. Preferably, a desirable roll compressive strength is at least about 100 MPa. They also should have enough stiffness to resist elastic deflection under the indentation loads needed to deform the SiC (and/or boron) fibers. Preferably, a desirable stiffness is at least about 10 GPa, and more preferably, at least about 30 GPa. Consolidating rolls 30 and 32 should also not bond to the copper matrix material under the conditions used in the consolidation process. Preferably, undesirable bonding between the rolls and the tape can be avoided by using a protective foil 17 (e.g., molybdenum foil) between the rolls and the tape, which does not bond to the rolls or to the tape. The protective foils on each side of the tape are then spooled separately on collecting means 29 after exiting the rolls.

Although rolls 30 and 32 can be made of a wide variety of materials (e.g., graphite, metals, ceramics (including crystalline ceramics), graphite generally has too low a stiffness and can show excessive deflection under indentation loads. This can result in wavy tapes. Molybdenum rolls have desirable strength, stiffness, and slow kinetics of adhesion, particularly with respect to copper, and are therefore suitable for the roll bonding of CMCs.

Consolidating rolls 30 and 32 are mounted on water-cooled shafts 34 and 36 driven by electric motor 38 and, preferably, reducer 40 to enhance torque at low rotational speeds. The rotational speed of consolidating rolls 30 and 32 can be varied, preferably up to about 30 revolutions per minute (rpm). Both rolls rotate at the same rate, however, upper roll 30 can be held stationery with respect to vertical movement while lower roll 32 is allowed to translate vertically. This can be accomplished by applying pressure to lower shaft 36 using one or more pneumatic cylinder(s) 42. Suitable pressure to lower shaft 36 using one or more pneumatic cylinders (e.g., pressurized with gas (e.g., argon)) are commercially available, and include those available from Brass Co. of Eden Prairie, Minn. Because shafts 34 and 36 are driven by motor 38, which is typically located outside enclosure 18, seals, such as ferrofluidic seals, can be used to prevent leaks. Shafts 34 and 36 are preferably water-cooled to keep their temperature lower than about 30° C. during consolidation.

Consolidating rolls 30 and 32 can be heated by a variety of means. A preferred means is shown in FIG. 1, which includes four banks of quartz heaters 43, 44, 45, and 46 surrounding consolidating rolls 30 and 32. Preferably, consolidating rolls 30 and 32 can be heated up to temperatures of about 1100° C. using such heaters. Examples of suitable such heaters are conventional quartz strip-heaters such as those available from Research Inc. of Minneapolis, Minn.

Preferably, the load applied by the consolidating means to the continuous SiC (and/or boron) fibers/ copper foil laminate is about 10 kilograms to about 1500 kilograms. More preferably, the load applied by the consolidating means to the continuous SiC (and/or boron) fibers/ copper foil laminate is about 25 kilograms per fiber. The force applied, however, depends, for example, on a variety of factors, such as the elastic, plastic, and creep indentation of the copper foils at a given temperature, the foil thickness, the number of SiC (and/or boron) fibers and fiber size and the consolidating means (e.g., consolidating rolls 30 and 32) and the number of SiC (and/or boron) fibers. For example, with a pair of molybdenum rolls consolidating ten SiC (and/or boron) fibers, a force of about 200 kilograms to about 250 kilograms is necessary to get a fully dense monotape at a temperature of about 800° C. at the contact point and at a linear velocity of about 30 cm/minute.

The position of the SiC (and/or boron) fibers before consolidation is important for controlling the final geometry and the microstructure of the CMC tape according to the present invention. As shown in FIG. 1, the fiber transport is preferably a continuous reel to reel operation using supply spools 24 and collecting spool 27, with transport of the fibers under tension (typically about 45–140 grams on each fiber). Positioned between these spools is alignment means 22, which is used to effect longitudinal alignment (i.e., parallel positioning in a side-by-side fashion) of the continuous SiC (and/or boron) fibers and-lamination between Cu foils.

Figure 2:
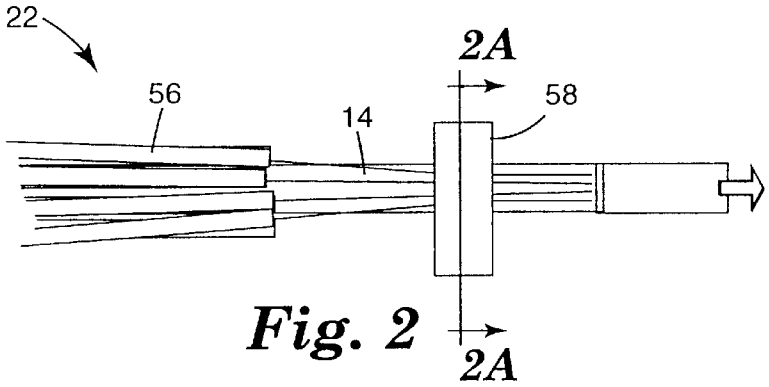
FIG. 2 is a schematic of an alignment guide tubes for use in the consolidating apparatus of FIG. 1.

A preferred alignment means utilizes a series of flexible, small diameter tubes to guide the SiC (and/or boron) fibers from the supply means into the glove box and the consolidation means in an aligned configuration. Referring to FIG. 2, SiC (and/or boron) fibers 14 and pass through guide tubes 56, and through aperture 58 which deliver the SiC (and/or boron) fibers 14 between the consolidating rolls (not shown) in a longitudinally aligned configuration. The flexible tubes are of sufficient diameter and length to freely guide the fibers and minimize argon leaking from the pressurized glove-box to the ambient atmosphere. For example, for making a 6 mm wide by 0.3 mm thick CMC tape with 24 vol. %, 0.14 micrometer diameter SiC fibers, a preferred inside diameter is 0.36 mm, with an outside diameter of 0.5 mm, and a length of about 1 meter. The touching of SiC (and/or boron) fibers 14 as they enter consolidating rolls is achieved by guiding fibers 14 from tubes 56 into the rectangular aperture 58. The initial touching of SiC (and/or boron) fibers 14 is necessary to initially maintain a perfect alignment within the copper matrix composite tape. In addition, referring to FIG. 2A, aligned SiC (and/or boron) fibers 14 are laminated between two copper foils 15. The copper foils are guided inside rectangular channels in aperture 58. The load applied during the first rolling pass is about 3 kilograms per fiber at a temperature of 800° C. and a rolling speed of 30 cm/min. The tape made on the first consolidation pass is wound on take-up spool 27. Such first pass tape consists of laterally touching fiber sandwiched between two copper foils 15. The tape is then consolidated a second time to separate the fibers. The second consolidation pass is done under about a force of 10 kilograms/per fiber at 800° C. and a rolling speed of 30 cm/min. During the second rolling pass, the combination of heat and pressure forces the metal to flow in between fibers as they become "non-touching" fibers. The distance between non-touching fibers is a function of, for example, temperature, pressure, and the foil thickness. Preferably the foil thickness ranges from 0.1 mm to 0.3 mm when making a CMC article with a fiber that is 0.140 mm in diameter. More preferably the foil thickness is 0.127 mm to get a 0.025 mm fiber to fiber spacing with a net fiber volume fraction equal to 0.28.

Alternatively, for example, a CMC article according to the present invention can be made in a single pass consolidation operation (rather than the two passes described above), wherein sufficiently high pressure(s) and temperature(s) are used during a single pass to force the copper between the SiC (and/or boron) fibers.

Typically, the purity of the copper matrix of CMC articles according to the present invention are typically at least 99.5% (preferably, at least 99.9%: more preferably, at least 99.95%) pure copper by weight.

Typically, elongated, continuous articles according to the present invention have a length of at least 3 meters, preferably, at least 10 meters, more preferably, at least 30 meters. Preferably, CMC articles according to the present invention are at least about 20 meters, and more preferably at least about 30 meters in length, although longer lengths may be desirable for certain applications.

Preferably, CMC articles according to the present invention have, at 25° C., an average tensile strength of at least 0.7 GPa (more preferably, at least 0.8 GPa; even more preferably, at least at least 0.9 GPa, and most preferably, at least 1 GPa, 1.5 GPa, 1.6 GPa, or even 1.65 GPa), and an average electrical conductivity of at least 50% IACS (more preferably, at least 55% IACS; even more preferably, at least 60% IACS, or even at least 70% IACS; and most preferably at least 75% IACS).

Preferably, CMC articles according to the present invention are capable of can be annealed to increase the electrical conductivity of the article. Such annealing can be done, for example, typically conducted in an inert atmosphere (e.g., argon) for 3–30 minutes at a temperature in the range from 250° C. to 850° C. Although annealing may be conducted at relatively low temperatures (e.g., 250–500° C.), required annealing times for these temperatures may be undesirably long. For example thermal exposure of CMC tape at 250° C. for 30 minutes provided a conductivity increase of 1% IACS. Preferably, the increase in electrical conductivity after annealing is at least 1% IACS, more preferably 2% IACS and even more preferably 4% IACS.

CMCs according to the present invention preferably comprise between about 15–30%by volume (more preferably between about 22–28%by volume) of the continuous SiC and/or boron reinforcing fibers, based on the total volume of the fibers and matrix.

Particularly useful forms of CMCs according to the present invention are tapes (monotapes or multilayered (e.g., two, three, four, five, six, seven, eight, nine, ten or more). A single layer is preferred to be able to wind the tape with a small bend radius. The minimum bend radius is a function of tape thickness (a thin tape is more flexible than a thick tape) and strength. The minimum bend radius is typically less than 50 mm and preferably equal or less than 10 mm without breaking the fibers. Although the desired construction and dimensions of a CMC tape may depend on the particular use, some preferred CMC tapes according to the present invention are, for a single monolayer, about 2–25 mm wide, and about 200 micrometers to about 2 mm (more preferably, about 200 micrometers to about 1 mm) thick. Further, although the desired construction and dimensions of a CMC tape may depend on the particular use, some preferred CMC tape according to the present invention have an average rectangular cross section of about 6 mm×0.3 mm.

Certain preferred CMCs according to the present invention (e.g., tapes and wires) are sufficiently flexible to be capable or being wrapped and unwrapped around a 20 mm (preferably 12 mm; more preferably 7 mm) diameter round rod without visibly damaging the CMC article.

Uses of CMCs according to the present invention include in high field pulsed magnet applications. For example, CMC (e.g., tape or wire) can be used to as the conductor winding. Techniques for making conductor (including armatures for high field pulsed magnet applications) are well known to those skilled in the art, and using CMCs according to the present invention to make conductor (including substantially helically wind copper matrix composite (e.g., wire or tape) according to the present invention) should be apparent to those skilled in the art after review the disclosure for the present invention.

Objects and advantages of this invention are further illustrated by the following examples, but the particular materials and amounts thereof recited in these examples, as well as other conditions and details, should not be construed to unduly limit this invention. All parts and percentages are by volume unless otherwise indicated.

EXAMPLE 1

A CMC monotape was made by roll bonding nineteen 140 micrometer diameter SiC fibers (dual carbon coated SiC fibers; average fiber tensile strength of 3.8 GPa; obtained under the trade designation "SCS-6" from Textron, Lowell, Mass.) between two copper foils (99.95% Cu oxygen-free, UNS C10200, 1.27 mm thick×6 mm wide×100 meter long; in the mill-annealed condition; obtained from US Brass and Copper, Dawner Groove, Ill.).

Figure 2A:
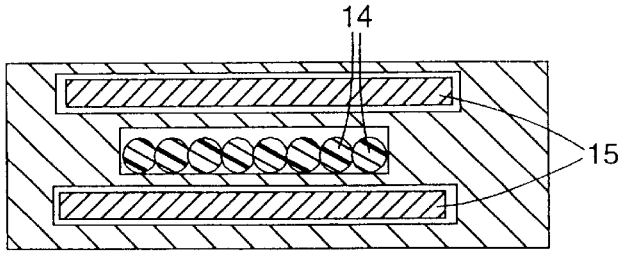
FIG. 2A is a cross-sectional view of the alignment means of FIG. 2 taken along line 2A.

More specifically, the CMC tape was prepared using a two pass roll bonding operation, the first pass producing a consolidated matrix/reinforcing fiber composite and the second producing a finished tape construction. Schematics of the equipment used to make the CMC tape are shown in FIGS. 1, 2, and 2A, which are described above. The first consolidation pass introduced side-by-side aligned fibers between two copper foil tapes by means of a collimator positioned 25 mm from the nip of the rollers. The laminate was compressed under a 50 kilogram load at 850° C. The linear speed of the laminate as it passed through the nip of the rollers was 5 mm/sec.

The resulting construction, which maintained the reinforcing fibers in a touching relationship along the neutral axis of the composite, was wound on a spool and compressed a second time by passing it through the roller nip under a 200 kilogram load at 850° C. The linear speed of 5 mm/sec for this second pass was again 5 mm/sec. During the second compression, the copper metal was plastically deformed, forcing it between the individual fibers, producing an average spacing between fibers of about 15 micrometers. The resulting CMC tape was 6.5 mm wide and 7 meters in length. Excess copper on both sides of the fiber-reinforced region was trimmed with a razor blade.

The average tensile strength of the Example 1 CMC monotape, at room temperature (i.e., about 25° C.) was determined substantially as described in ASTM-345 (1992), the disclosure of which is incorporated herein by reference. The strength was measured on a minimum of five 10 cm long×3.8 mm wide×0.32 mm thick samples. The test samples were pulled in displacement, control in a screw-driven universal testing frame (obtained under the trade designation "INSTRON"; 4201 frame, from Instron, Canton, Mass.). The load during testing and at failure was monitored by a 10,000 Newton load cell (obtained under the trade designation "INSTRON" from Instron). The Example 1 tape was held during testing by a pneumatic wedge grip (obtained from Instron). The metallic wedges were buffered with a 0.1 mm thick aluminum (annealed 99% aluminum) foil. The axis of the sample to be tested was aligned with the center line of the heads of the testing machine to avoid bending stresses. The composite tape was tested at and a cross-head speed of 0.03 cm/second. The maximum load from the load cell was electronically recorded (using software obtained under the trade designation "SERIES IX INSTRON" from Instron). The width and thickness of each test. sample were measured with a micrometer. The strength, σ, was calculated by using the following formula:

$$\sigma = \frac{P}{wt}$$

where P is the maximum load, t is the tape thickness and w is the tape width. The average tensile strength of the Example 1 CMC material, based on an average of five samples was 0.7 GPa.

The electrical conductivity of the Example 1 CMC tape, at room temperature (i.e., 25° C.), as determined substantially as described in ASTM method B 193-87 (1993), the disclosure of which is incorporated herein by reference. The electrical resistivity of a 3 meter long strip of the Example 1 CMC tape of uniform cross-section was measured with a Kelvin-type double bridge. More. specifically, the electrical resistivity was measured using a digital ohmeter (Model D3500 from Davis Instrument, Baltimore Md.). The ohmeter was turned on at least 15 minutes before being used. The temperature of the tape to be evaluated was 24° C.±1° C. The average width (about 6 mm) and thickness (about 0.3 mm) of the tape to be measured before the test with a micrometer. Twenty resistance measurements, alternated between direct current and reversed current, were taken in direct succession. The electrically resistivity was recorded, and the volume electrical resistivity calculated using the following equation:

$$\rho_v = (A/L)R$$

where A is the cross sectional area, L is the length (3 meters) and R is the measured resistance. The volume conductivity was then converted into the international annealed copper standard conductivity (% IACS) by using the equation:

$$\%IACS = \frac{172.41}{\rho_v}$$

where $\rho_v$ is expressed in micro-ohms centimeters($\mu\Omega\cdot$cm). The electrical conductivity of the Example 1 tape, which is an average of twenty measurements on the same sample, was about 64% IACS.

A 3 meter section of Example 1 tape was heat treated at 250° C. for 30 minutes in an argon environment with less than 5 ppm oxygen and less than 10 ppm water. The electrical conductivity of the heat-treated (annealed) sample, at 24° C.±1° C., was 69% IACS.

The bend strength of the Example 1 CMC tape was inferred based on a test developed from ASTM Test E 290-92 (1992), the disclosure of which is incorporated herein by reference. A 10 cm strip of Example 1 CMC tape was bent around cylindrical pins of diminishing diameters until the fibers in the tape fractured. The fiber fracture is typically accompanied by the clear formation of a surface crack penetrating through the copper. The maximum tensile stress in the tape due to bending, and referred to as the bending strength, was calculated using the equation:

$$\sigma = \frac{f\,Ed}{2R^*}$$

where f is the fiber volume fraction, E is the Young's modulus of the fiber, d is the diameter of the fiber, and R* is the minimum critical bend radius at which the tape stays intact during bending. The fiber volume fraction, as determined by image analysis, was 0.25, the fiber Young's Modulus was 415 GPa, the fiber diameter was 0.14 mm and the measured minimum radius was 8.5 mm. The bend strength of the Example 1 CMC tape, as determined by the minimum bending radius, was inferred to be 0.85 GPa.

A cross-section of the Example 1 tape was polished using conventional techniques. The size of the last polished material used was 1 micrometer (diamond). The polished cross-section was viewed at 250× using an scanning electron microscope. The average grain size of the copper in the matrix, based on twenty measurements from the photomicrograph, was 50 micrometers.

EXAMPLE 2

A 20 meter CMC tape was made substantially as described in Example 1, except the SiC fibers were coated with a 2 micrometer thick titanium alloy (Ti-6% Al-4% V) coating. The titanium alloy coating was deposited on the fibers using electron beam evaporation.

The average longitudinal tensile strength, electrical conductivity, and bend strength of the Example 2 CMC article were determined, as described in Example 1, to be 1 GPa, 63% IACS, and 1.1 GPa, respectively.

EXAMPLE 3

A 6 meter CMC tape was made substantially as described in Example 1, except the SiC fiber used was that obtained from by Textron, Lowell, Mass. under the trade designation "ULTRA" (average fiber tensile strength of 6.2 GPa), which had a dual carbon coating on the fiber.

The average longitudinal tensile strength, electrical conductivity, and bend strength of the Example 3 CMC article were determined, as described in Example 1, to be 1.25 GPa, 55% IACS, and 1.65 GPa, respectively.

EXAMPLE 4

A 40 meter CMC tape was fabricated substantially as described in Example 1, except the SiC fiber used was that obtained from by Textron under the trade designation "ULTRA" (average fiber tensile strength of 6.2 GPa), which had a thin silicon rich layer.

The average tensile strength of the Example 4 CMC tape was determined, as described in Example 1, to be 1.4 GPa. An examination of the stress-displacement curve associated with the tensile strength measurement, however, suggested that the fibers were not uniformly loaded up to the failure point of the tape, as evidenced by the multiple secondary stress peaks following the first maximum stress. Since the annealed copper matrix was soft, the secondary stress peaks were attributed to intact fibers. Thus, it is believed that the actual average tensile strength of the Example 4 CMC tape was greater than 1.4 GPa.

The electrical conductivity and bend strength of the Example 4 CMC article were determined, as described in Example 1, to be 64–72% IACS, and 1.67 GPa, respectively.

A 3 meter section of Example 4 tape was heat treated at 850° C. for 3 minutes in an argon environment with less than 5 ppm oxygen and less than 10 ppm water. The electrical conductivity of the heat-treated (annealed) sample, at 24° C.±1° C., was 64–76% IACS.

The source of variability in the conductivity measurements is not known, however, it may have been due to resistance at the measurement contact area. The higher electrical conductivity may be representative of the intrinsic conductor conductivity since it corresponds to the expected rule of mixture conductivity, $$\% \text{ IACS}_{Cu/siC}=(1-f) \% \text{ IACS}_{Cu}$$

where f is the fiber volume fraction. Pure copper has a 100% IACS conductivity and f=0.25. Therefore the expected composite conductivity for the Example 4 CMC tape was 75% IACS.

Figure 3:
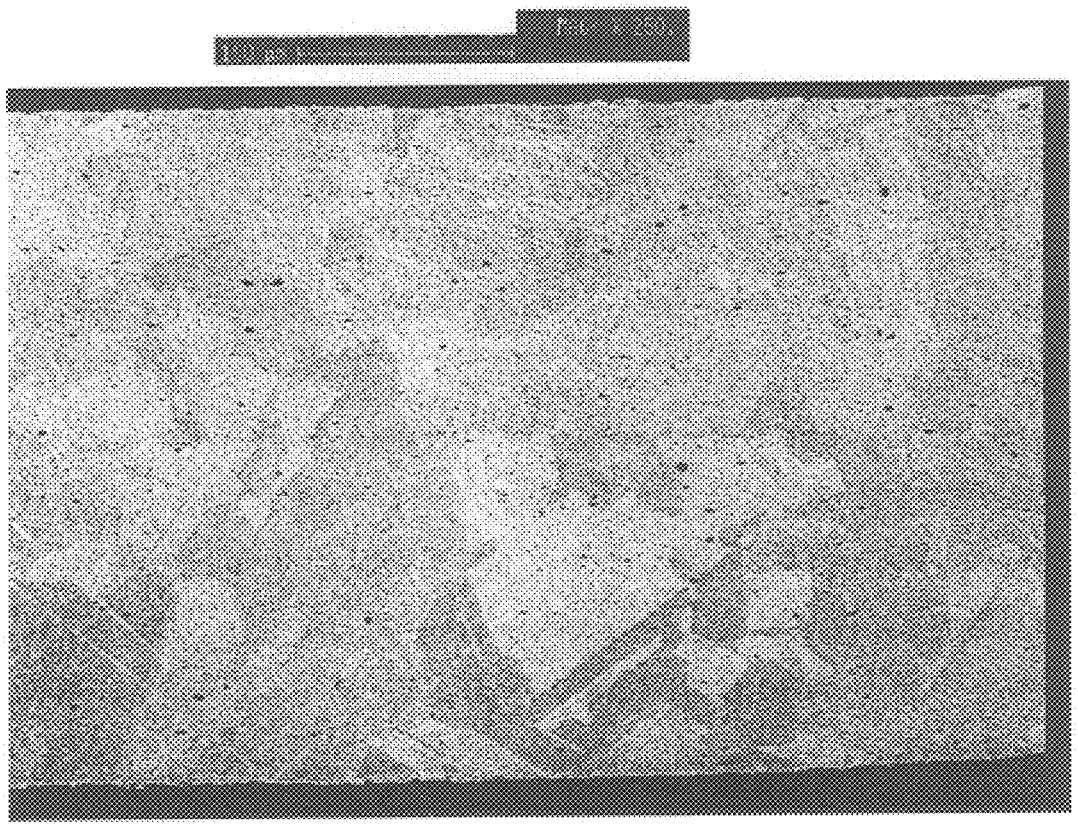
FIG. 3 is a scanning electron photomicrograph of copper matrix in a copper matrix composite tape according to the present invention.

A cross-section of the Example 4 tape was polished and examined with a scanning electron microscope as described in Example 1. FIG. 3 is a photomicrograph of the polished section at a magnification of 250×. The average grain size of the copper in the matrix, based on twenty measurements from the photomicrograph, was 55 micrometers.

EXAMPLE 5

A 10 meter CMC tape was prepared using boron fibers in place of SiC fibers and a fabrication process similar to that described in Example 1. The boron fibers, which had no coatings and an average tensile strength of 3.4 Gpa, were obtained from Textron.

More specifically, the fabrication process differed from that used in Example 1 in that it used a single pass bonding operation that compressed the copper foil tape/boron fiber laminate under a 200 Kg load at 850° C. at a linear laminate speed of 5 mm/sec. The boron fibers in the resulting tape were uniformity spaced across the width of the tape. Subsequent to formation, the tape was annealed at 850° C. for three minutes in an argon environment having less that 12 ppm water.

The average tensile strength of the Example 5 CMC tape was determined, as described in Example 1, to be 0.6 GPa. The electrical conductivity and bend strength of the tape were determined, as described in Example 1, to be 69–78% IACS, and 0.8 GPa, respectively.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An elongated, continuous copper matrix composite article comprising at least one layer of a plurality of at least one of continuous, longitudinally aligned, non-touching monofilament SiC or boron reinforcing fibers, wherein said elongated article has, at 25° C., an average tensile strength of at least 0.7 GPa and an electrical conductivity of at least 55% IACS, and wherein the copper of said copper matrix has an average grain size of greater than 10 micrometers.

2. The elongated composite article according to claim 1, wherein the copper of said copper matrix is at least 99.5% by weight pure.

3. The elongated composite article according to claim 1, wherein the copper of said copper matrix is at least 99.9% by weight pure.

4. The elongated composite article according to claim 1, wherein the copper of said copper matrix has an average grain size of greater than 40 micrometers.

5. The elongated composite article according to claim 1, wherein the copper of said copper matrix has an average grain size in the range from 10–55 micrometers.

6. The elongated article according to claim 1 having an average tensile strength of at least 1.25 GPa.

7. The elongated article according to claim 6 having an electrical conductivity of at least 75% IACS.

8. The elongated article according to claim 1 having an average tensile strength of at least 1.65 GPa.

9. The elongated article according to claim 1 having an electrical conductivity of at least 70% and an average tensile strength of at least 1 GPa.

10. The elongated article according to claim 1 having an electrical conductivity of at least 75% IACS.

11. The elongated article according to claim 1 wherein said SiC fibers have an average tensile strength of at least 6 GPa.

12. The elongated article according to claim 1 which has a length of at least 3 meters.

13. The elongated article according to claim 12 which is a wire.

14. The elongated article according to claim 12 which is a tape.

15. The elongated article according to claim 1 which has a length of at least 30 meters.

16. The elongated article according to claim 1 is sufficiently flexible to be wrapped and unwrapped around a 20 mm diameter round without visibly damaging said article.

17. The elongated article according to claim 1 is sufficiently flexible to be wrapped and unwrapped around a 7 mm diameter round without visibly damaging said article.

18. An elongated, continuous copper matrix composite article comprising at least one layer of a plurality of continuous, longitudinally aligned, non-touching monofilament SiC reinforcing fibers, wherein said elongated article has, at 25° C., an average tensile strength at least 0.7 GPa and an electrical conductivity of at least 50% IACS, and wherein the elongated article is capable of retaining at least 90 percent of its average tensile strength, at 25° C., after being annealed for 3 minutes at 850° C. in an argon environment with less than 5 ppm oxygen and less than 10 ppm water.

19. The elongated composite article according to claim 18 which is capable of at least retaining, after said annealing, at least 90 percent of its electrical conductivity.

20. The elongated composite article according to claim 18 which is capable of increasing its electrical conductivity by at least 2% by said annealing.

21. The elongated composite article according to claim 18, wherein the copper of said copper matrix, prior to said annealing, is at least 99.5% by weight pure.

22. The elongated composite article according to claim 18, wherein the copper of said copper matrix, prior to said annealing, is at least 99.9% by weight pure.

23. The elongated composite article according to claim 18, wherein the copper of said copper matrix, prior to said annealing, has an average grain size of greater than 40 micrometers.

24. The elongated composite article according to claim 18, wherein the copper of said copper matrix, prior to said annealing, has an average grain size in the range from 10–55 micrometers.

25. The elongated article according to claim 18 having, prior to said annealing, an average tensile strength of at least 1.25 GPa.

26. The elongated article according to claim 25 having, prior to said annealing, an electrical conductivity of at least 75% IACS.

27. The elongated article according to claim 18 having, prior to said annealing, an average tensile strength of at least 1.65 GPa.

28. The elongated article according to claim 18 having, prior to said annealing, an electrical conductivity of at least 70% and an average tensile strength of at least 1 GPa.

29. The elongated article according to claim 18 having an electrical conductivity of at least 75% IACS.

30. The elongated article according to claim 18 wherein, prior to said annealing, said SiC fibers have an average tensile strength of at least 6 GPa.

31. The elongated article according to claim 18 which, prior to said annealing, has a length of at least 3 meters.

32. The elongated article according to claim 31 which is a wire.

33. The elongated article according to claim 31 which is a tape.

34. The elongated article according to claim 18 which, prior to said annealing, has a length of at least 30 meters.

35. The elongated article according to claim 18 which, prior to said annealing, is sufficiently flexible to be wrapped and unwrapped around a 20 mm diameter round without visibly damaging said article.

36. The elongated article according to claim 18 which, prior to said annealing, is sufficiently flexible to be wrapped and unwrapped around a 7 mm diameter round without visibly damaging said article.

37. A method for a continuous copper matrix composite tape comprising at least one layer of a plurality of continuous, longitudinally aligned, non-touching monofilament SiC reinforcing fibers, wherein said article has, at 25° C., an average tensile strength of at least 0.7 GPa and an electrical conductivity of at least 55% IACS, and wherein the copper of said copper matrix has an average grain size of greater than 10 micrometers, said method comprising:

providing a plurality of continuous monofilament SiC fibers;

providing at least two copper foils;

providing a consolidating apparatus comprising:

consolidating means for consolidating the continuous monofilament SiC fibers and copper foils into the continuous metal matrix composite tape, said consolidating means including means for applying heat and pressure;

means for providing a nonreactive environment around the consolidating means; and alignment means to effect longitudinal alignment of the continuous monofilament SiC fibers and copper foils;

providing a nonreactive environment around said consolidating means;

advancing said continuous monofilament SiC fibers and copper foils into said alignment means to effect longitudinal alignment of said continuous monofilament SiC fibers and copper foils; and advancing the longitudinally aligned continuous monofilament SiC fibers and copper foils through said consolidating means to consolidate said continuous monofilament SiC fibers and copper foils into said continuous copper matrix composite tape.

38. The method according to claim 37 wherein said continuous monofilament SiC fibers and copper foils pass through said consolidating means twice.

39. A method for a continuous copper matrix composite tape comprising at least one layer of a plurality of continuous, longitudinally aligned, non-touching monofilament SiC reinforcing fibers, wherein said article has, at 25° C., an average tensile strength of at least 0.7 GPa and an electrical conductivity of at least 55% IACS, and wherein the copper of said copper matrix has an average grain size of greater than 10 micrometers, said method comprising:

providing a plurality of continuous monofilament SiC fibers;

providing at least two copper foils;

providing a consolidating apparatus comprising:

an enclosure;

a nonreactive environment in said enclosure;

supply spools having said plurality of continuous monofilament SiC fibers thereon, supply spools having said copper foils thereon;

a collecting spool for collecting a continuous copper matrix composite tape;

consolidating means within said enclosure positioned between said supply spools and said collecting spool for consolidating the continuous monofilament SiC fibers and copper foils into the continuous metal matrix composite tape, said consolidating means including means for applying heat and pressure; and alignment means positioned between said supply spools and said consolidating means to effect longitudinal alignment of the continuous monofilament SiC fibers and copper foils;

providing a nonreactive environment in said enclosure;

advancing said continuous monofilament SiC fibers and copper foils from said supply spools into said alignment means to effect longitudinal alignment of said fibers and foils;

advancing the longitudinally aligned continuous monofilament SiC fibers and copper foils through said consolidating means to consolidate said continuous monofilament SiC fibers and said copper foils into said continuous copper matrix composite tape, wherein heat and pressure are applied to said fibers and foils during consolidation by said means for applying heat and pressure; and collecting said continuous copper matrix composite tape on said collecting spool.

40. The method according to claim 39 wherein said continuous monofilament SiC fibers and copper foils pass through said consolidating means twice.

41. A method for making a continuous copper matrix composite tape comprising at least one layer of a plurality of continuous, longitudinally aligned, non-touching monofilament SiC reinforcing fibers, wherein said article has, at 25° C., an average tensile strength of at least 0.7 GPa and an electrical conductivity of at least 55% IACS, and wherein the copper of said copper matrix has an average grain size of greater than 10 micrometers, said method comprising:

providing a plurality of continuous monofilament SiC fibers;

providing at least two copper foils;

providing a consolidating means, said consolidating means including means for applying heat and pressure;

providing a nonreactive environment around said consolidating means;

longitudinally aligning said continuous monofilament SiC fibers and copper foils; and advancing the longitudinally aligned continuous monofilament SiC fibers and copper foils through said consolidating means to consolidate said continuous monofilament SiC fibers and copper foils into said continuous copper matrix composite tape, wherein heat and pressure are applied to said fibers and foils during consolidation by said means for applying heat and pressure.

42. The method according to claim 41 wherein said continuous monofilament SiC fibers and copper foils pass through said consolidating means twice.

43. A method for making a continuous copper matrix composite tape comprising at least one layer of a plurality of continuous, longitudinally aligned, non-touching monofilament SiC reinforcing fibers, wherein said article has, at 25° C., an average tensile strength of at least 0.7 GPa and an electrical conductivity of at least 55% IACS, and wherein the copper of said copper matrix has an average grain size of greater than 10 micrometers, said method comprising:

providing a plurality of continuous monofilament SiC fibers;

providing at least two copper foils;

providing a consolidating apparatus capable of consolidating said continuous monofilament SiC fibers and copper foils into the continuous copper matrix composite tape in a nonreactive environment, and aligning the continuous monofilament SiC fibers and copper foils to effect longitudinal alignment of the continuous monofilament SiC fibers and copper foils, said consolidating apparatus including means for applying heat and pressure; and aligning said continuous monofilament SiC fibers and copper foils to effect longitudinal alignment of said continuous monofilament SiC fibers and copper foils, and consolidating the longitudinally aligned continuous monofilament SiC fibers and copper foils into said continuous copper matrix composite tape, wherein heat and pressure are applied to said fibers and foils during consolidation by said means for applying heat and pressure.

44. The method according to claim 43 wherein said continuous monofilament SiC fibers and copper foils pass through said consolidating means twice.

45. A method for making a continuous copper matrix composite tape comprising at least one layer of a plurality of continuous, longitudinally aligned, non-touching monofilament SiC reinforcing fibers, wherein said article has, at 25° C., an average tensile strength of at least 0.7 GPa and an electrical conductivity of at least 55% IACS, and wherein the copper of said copper matrix has an average grain size of greater than 10 micrometers, said method comprising:

providing a plurality of continuous monofilament SiC fibers;

providing at least two copper foils;

providing consolidating rolls;

providing means for applying heat and pressure during consolidation of the continuous monofilament SiC fibers and copper foils into the continuous copper matrix composite tape;

providing a nonreactive environment around said consolidating rolls;

longitudinally aligning said continuous monofilament SiC fibers and copper foils; and advancing the longitudinally aligned continuous monofilament SiC fibers and copper foils through said consolidating rolls to consolidate the longitudinally aligned continuous monofilament SiC fibers and copper foils into said continuous metal matrix composite tape, wherein heat and pressure are applied to said fibers and foils during consolidation by said means for applying heat and pressure.

46. The method according to claim 45 wherein said continuous monofilament SiC fibers and copper foils pass through said consolidating means twice.

* * * * *

UNITED STATES PATENT AND TRADEMARK OFFICE

CERTIFICATE OF CORRECTION

PATENT NO. : 6,416,876 B1
DATED : July 9, 2002
INVENTOR(S) : Deve, Herve E.

It is certified that error appears in the above-identified patent and that said Letters Patent is hereby corrected as shown below:

Title page,
Item [56], OTHER PUBLICATIONS, "Y. Sakaki" should read -- Y. Sakai --.

Column 1,
Line 54, after "preferably" delete "at least".

Column 2,
Line 14, after "conductivity" delete "is"
Line 32, after "preferably" delete "at least"

Column 8,
Line 16, after "preferably" delete "at least"

Column 10,
Line 19, after "More" delete ".".

Signed and Sealed this

Third Day of June, 2003

JAMES E. ROGAN
*Director of the United States Patent and Trademark Office*